United States Patent [19]

Davis et al.

[11] Patent Number: 4,676,009

[45] Date of Patent: Jun. 30, 1987

[54] INFLATED SHOE

[76] Inventors: Robert E. Davis, 2230 Secretariet, Stafford, Tex. 77477; George Spector, 233 Broadway - RM 3615, New York, N.Y. 10007

[21] Appl. No.: 870,833

[22] Filed: Jun. 5, 1986

[51] Int. Cl.[4] ..... A43B 13/20; A43B 13/18

[52] U.S. Cl. ..... 36/7.8; 36/29; 36/116; 272/114

[58] Field of Search ..... 36/7.5, 7.8, 28, 29, 36/116, 132, 136, 3 B; 272/70, 144, 114

[56] References Cited

U.S. PATENT DOCUMENTS

| | | | |
|---|---|---|---|
| 683,595 | 10/1901 | Drouillard | 36/116 |
| 1,011,460 | 12/1911 | Maddocks | 36/29 |
| 1,516,395 | 11/1924 | Miceli | 36/7.8 |
| 2,128,134 | 8/1938 | Gusto | 36/29 |
| 2,430,466 | 11/1947 | Hedman | 36/7.8 |
| 2,720,714 | 10/1955 | Krohn et al. | 36/116 |
| 2,756,517 | 7/1956 | Youtz | 272/114 |
| 2,968,105 | 1/1961 | Rizzo | 36/7.8 |
| 3,423,852 | 1/1969 | Smith | 36/7.5 |
| 4,109,909 | 8/1978 | Csutor | 272/70 |
| 4,525,941 | 7/1985 | Ruth, Jr. | 36/116 |

FOREIGN PATENT DOCUMENTS

| | | | |
|---|---|---|---|
| 2455524 | 5/1976 | Fed. Rep. of Germany | 272/114 |
| 14955 | of 1894 | United Kingdom | 36/29 |

*Primary Examiner*—Werner H. Schroeder
*Assistant Examiner*—Steven N. Meyers

[57] ABSTRACT

An inflated shoe is provided and consists of a hollow pneumatic circular tube, a protective bottom member for engaging the ground, a cushion member within the tube and a shoe removably attached to the cushion member.

4 Claims, 4 Drawing Figures

INFLATED SHOE

BACKGROUND OF THE INVENTION

The instant invention relates generally to pneumatic footwear and more specifically it relates to an inflated shoe.

Numerous pneumatic footwear have been provided in prior art that are adapted to be attached to the feet of people with chambers of cushioning air. For example, U.S. Pat. Nos. 1,545,437; 2,430,466 and 2,756,517 all are illustrative of such prior art. While these units may be suitable for the particular purpose to which they address, they would not be as suitable for the purposes of the present invention as heretofore described.

SUMMARY OF THE INVENTION

A primary object of the present invention is to provide an inflated shoe that will overcome the shortcomings of the prior art devices.

Another object is to provide an inflated shoe that can be used by a child for jumping, walking and running at play.

An additional object is to provide an inflated shoe that can be used by a person for bouncing up and down to provide an exercise to remove excess weight.

A further object is to provide an inflated shoe that is simple and easy to use.

A still further object is to provide an inflated shoe that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
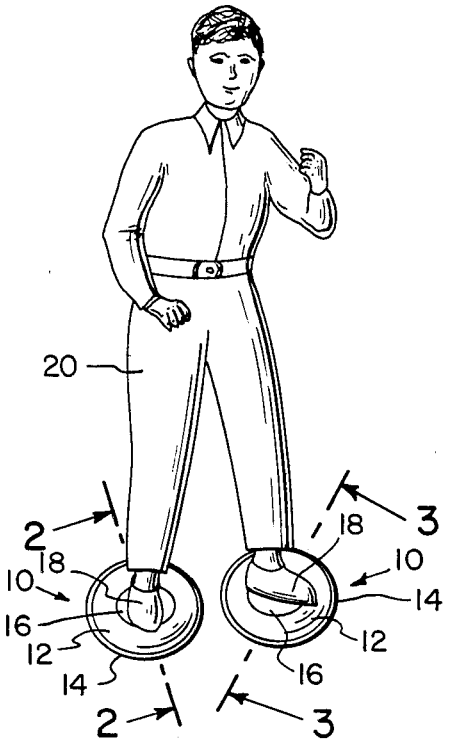
FIG. 1 is a perspective view of the invention in use.
Figure 2:
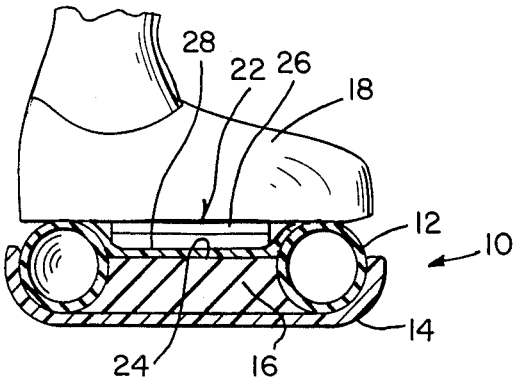
FIG. 2 is a cross sectional view taken along line 2—2 in FIG. 1.
Figure 3:
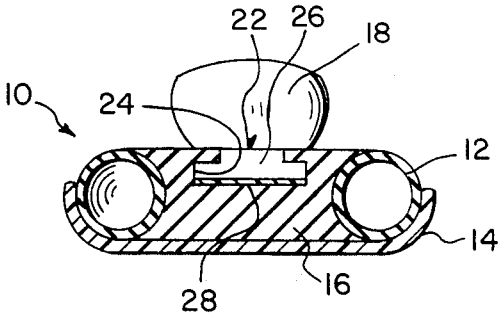
FIG. 3 is a cross sectional view taken along line 3—3 in FIG. 1.
Figure 4:
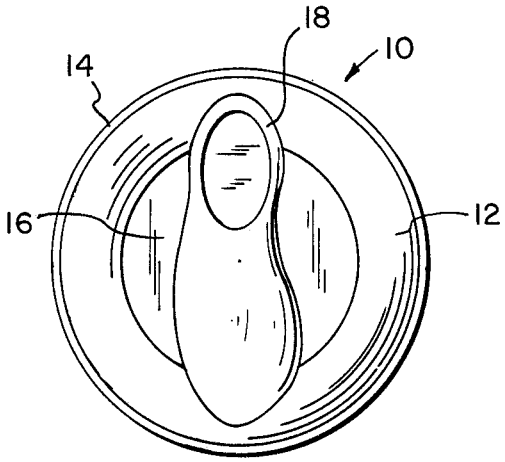
FIG. 4 is a top view thereof.

Turning now descriptively to the drawings, in which similar reference characters denote similar elements throughout the several views, FIGS. 1 through 4 illustrates an inflated shoe 10 that consists of a hollow pneumatic circular tube 12. A protective bottom member 14 is affixed to underside of the tube 12 for engaging the ground. A cushion member 16 is affixed within the tube 12. A shoe 18 is worn by user 20 of the inflated shoe 10.

A device 22 is provided for removably attaching the shoe 18 to the cushion member 16.

The device 22 consists of the cushion member 16 having an inverted T-shaped track 24 within top surface thereof. An inverted T-shaped tongue 26 is affixed to bottom of the shoe 18 whereby the tongue slides within the track 24 for securement thereto. A teflon slide member 28 is placed within bottom of the track 24 to aid in applying the tongue 26.

The hollow pneumatic circular tube 12 is fabricated out of elastic rubber material. The protective bottom member 14 is fabricated out of teflon material. The cushion member 16 is fabricated out of hard rubber material.

To use the inflated shoe 10, two of the same are secured to the feet of user 20 as shown in FIG. 1. It is obvious that a bouncing effect can be obtained when the user walks, runs or jumps, which can be very amusing to the user and will afford an exercise to remove excess weight.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An inflated shoe comprising:

(a) a hollow pneumatic circular tube; having an inner perimeter surface;

(b) a protective bottom member affixed to underside of said tube for engaging the ground;

(c) a cushion member affixed within said inner perimeter surface whereby said tube surrounds said cushion member;

(d) a shoe worn by user of said inflated shoe; and (e) means for removeably attaching said shoe to said cushion wherein said removeably attaching means includes:

(a) said cushion member having an inverted T-shaped track within top surface thereof; and (b) an inverted T-shaped tongue affixed to bottom of said shoe, said tongue slideable within said track for securement therto, further comprising a teflon slide member placed within bottom of said track to aid in applying said tongue within said track.

2. An inflated shoe as recited in claim 1, wherein said hollow pneumatic circular tube is fabricated out of elastic rubber material.

3. An inflated shoe as recited in claim 2, wherein said protective bottom member is fabricated out of teflon material.

4. An inflated shoe as recited in claim 3, wherein said cushion member is fabricated out of hard rubber material.

* * * * *